United States Patent [19]

Masuda

[11] 4,232,961

[45] Nov. 11, 1980

[54] IMAGE FORMATION APPARATUS

[75] Inventor: Takeshi Masuda, Yokohama, Japan

[73] Assignee: Canon Kabushiki Kaisha, Tokyo, Japan

[21] Appl. No.: 925,547

[22] Filed: Jul. 17, 1978

[30] Foreign Application Priority Data

Jul. 22, 1977 [JP] Japan ..... 52/88175

[51] Int. Cl.[2] ..... G03G 15/00

[52] U.S. Cl. ..... 355/14 R; 355/3 TR; 355/3 FU

[58] Field of Search ..... 355/3 R, 3 TR, 16, 14, 355/3 FU, 4, 3 BE; 219/216

[56] References Cited

U.S. PATENT DOCUMENTS

| | | | |
|---|---|---|---|
| 2,986,466 | 5/1961 | Kaprelian | 355/4 X |
| 3,690,756 | 9/1972 | Smith | 355/4 |
| 3,697,176 | 10/1972 | Kuehnle | 355/5 X |
| 3,838,919 | 10/1974 | Takahashi | 355/4 |
| 3,893,761 | 7/1975 | Buchan et al. | 355/3 TR |
| 3,970,383 | 7/1976 | Honda et al. | 355/4 |
| 4,027,966 | 6/1977 | Jordan | 355/16 |

OTHER PUBLICATIONS

*Research Disclosure,* No. 14510, "Web Tracking Apparatus", pp. 29–31, May 1976.

*Primary Examiner*—R. L. Moses

*Attorney, Agent, or Firm*—Fitzpatrick, Cella, Harper & Scinto

[57] ABSTRACT

An image formation apparatus comprises a photosensitive medium, elements for forming an electrostatic latent image on the photosensitive medium, a developing device for developing the electrostatic latent image with the aid of toner, an intermediate transfer medium to which the toner image formed by the developing device is transferred, an element for transferring to a recording medium the toner image transferred to the intermediate transfer medium, and a control device for operating the transfer means after the toner image formed on the photosensitive medium has been transferred to the intermediate transfer medium.

13 Claims, 12 Drawing Figures

| | |
|---|---|
| FIG. 4A | FIG. 4B |

FIG. 8A

| | SEQUENCE NO / OPERATIONS / SENSOR / FUNCTIONS | | START | MECHANICAL PARTS DRIVEN | TRANSFERRING PARTS DRIVEN |
|---|---|---|---|---|---|
| MECHANICAL PARTS OF COPY STATION | ORIGINAL DRUM ROTATION | No.1 ~ 3 | | ← | |
| | PHOTO-SENSITIVE DRUM ROTATION | No.1 ~ 3 | | ← | |
| | DEVELOPING DEVICE OPERATED | No.1 ~ 3 | | ← | |
| | CLEANER OPERATED | No.1 ~ 3 | | ← | |
| | | | | | |
| TRANSFERRING PARTS | CHARGERS OPERATED | No.1 ~ 3 | | | ← |
| | EXPOSURE LAMP OPERATED | No.1 ~ 3 | | | ← |
| | ELECTROMETER OPERATED | No.1 ~ 3 | | | |
| | | | | | |
| TRANSFERRING BELT PARTS | TRANSFER BELT FED | | | | |
| | DISCHARGER (1) OPERATED | | | | |
| | EDGE CONTROLLER OPERATED | | | | |
| | CLEANER OPERATED | | | | |
| | TRANSFER CHARGER OPERATED | | | | |
| | DISCHARGER (2) OPERATED | | | | |
| | CONTACT ROLLER OPERATED | | | | |
| | PRESSING ROLLER OPERATED | | | | |
| | | | | | |
| CLOTH FEEDING PARTS | CLOTH FEED DRUM ROTATED | | | | |
| | TRACKING DEVICE OPERATED | | | | |
| | CLOSS GUIDER OPERATED | | | | |
| | DANCER ROLL OPERATED | | | | |
| | | | | | |
| | TORQUE MOTOR OPERATED | | | | |
| | COOLING ROLL OPERATED | | | | |
| | COOLING BLOWER OPERATED | | | | |
| | FIXING HEATER OPERATED | | | | |
| | SHAKING OFF | | | | |

IMAGE FORMATION APPARATUS

BACKGROUND OF THE INVENTION

1. Field of the Invention

This invention relates to an image formation apparatus in which image formation is effected on a long footage of recording medium.

2. Description of the Prior Art

Heretofore, to form a plurality of images on a single recording medium, a plurality of photosensitive drums having toner images formed thereon have been caused to pass or toner images have been formed on a single photosensitive drum at distinct times and such toner images have been transferred to a recording medium.

When a plurality of images are repetitively formed on a long footage of recording medium by the use of the image formation apparatus as described above, it has sometimes been the case that a predetermined number of images fails to be formed on the whole of a long footage of recording medium like one image at a location on the recording medium, two images at a location on the recording medium, and so on.

SUMMARY OF THE INVENTION

In view of these points, the present invention intends to provide an image formation apparatus improved in the above-noted points.

It is another object of the present invention to provide an image formation apparatus in which for the images formed on a plurality of photosensitive mediums to be transferred to a single recording medium, the images formed on the plurality of photosensitive mediums may be transferred to predetermined locations on the recording medium.

Other objects of the present invention will become apparent from the following detailed description of embodiments of the invention taken in conjunction with the accompanying drawings.

DESCRIPTION OF THE PREFERRED EMBODIMENTS

Description will hereinafter be made of a printing apparatus as an application of the image formation apparatus according to the present invention.

The printing apparatus has a plurality of image originals and each of these image originals is transferred to a photosensitive medium and printed onto a web of cloth which is a recording medium.

Such an embodiment will be described by reference to the drawings.

Figure 1:
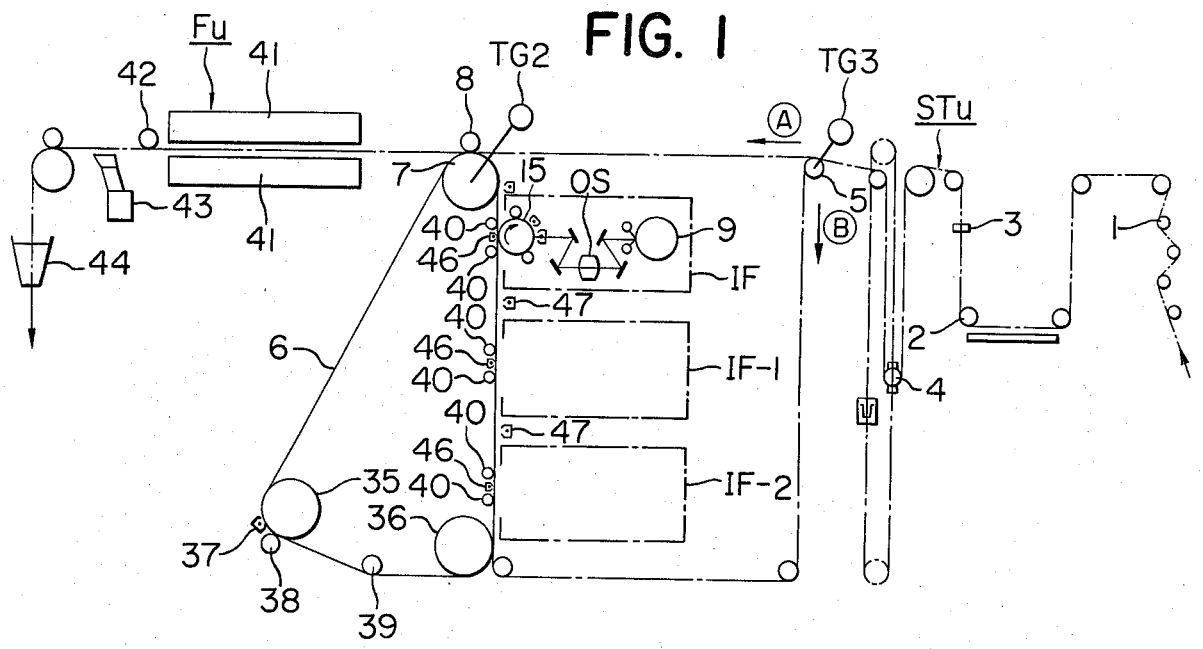
FIG. 1 is a view showing the construction of the image formation apparatus according to the present invention.

FIG. 1 is a view showing the construction of an embodiment of the present invention. Designated by STU is a supply station from which a web of cloth as a transfer medium is supplied to an image formation station.

The web of cloth is passed through a tension bar 1 so as to be provided with a tension and has its snake-like movement corrected by a tracking device 2 and a cross guider 3, whereafter it is guided to the image formation station while having its tension adjusted by the weight of a dancer roll 4. The transport of the cloth is imparted by a torque motor 5. There are two paths to the image formation station, and where the images are to be directly transferred to the web of cloth, it is passed along a path B so that the image is directly transferred thereto from a photosensitive drum. In the indirect transfer method, the cloth is passed along a path A and an image pre-transferred onto a transfer belt 6 is further transferred to the web of cloth at a belt drive 7 by a press roll 8.

Designated by IF is the image formation station and three such image formation stations are perpendicularly disposed in the present embodiment. One of them is shown in detail in FIG. 2, wherein an image on an image original drum 9 is projected onto a photosensitive drum 11 by a light source through a mirror 12 and an optical lens unit 13 forming an optical system OS disposed intermediately of the photosensitive drum 11 and the image original drum 9. The optical system OS comprises four mirrors 12 and the optical lens unit 13. The optical lens unit 13 is provided with a focus adjusting mechanism. Such mechanism has a mechanism for vertically moving a mirror holding portion 14 for adjusting the length of the optic axis by the use of adjust screw 15, and a mechanism for adjusting the length of the optic axis by $\pm 10$ mm, for instance, by the use of an adjust screw for vertically moving the optical lens unit 13.

The image original drum 9 has the image original wrapped about the periphery thereof accurately without a seam. Alternatively, the image original may be directly provided on the drum in the form of a photograph or by printing.

Figure 3:
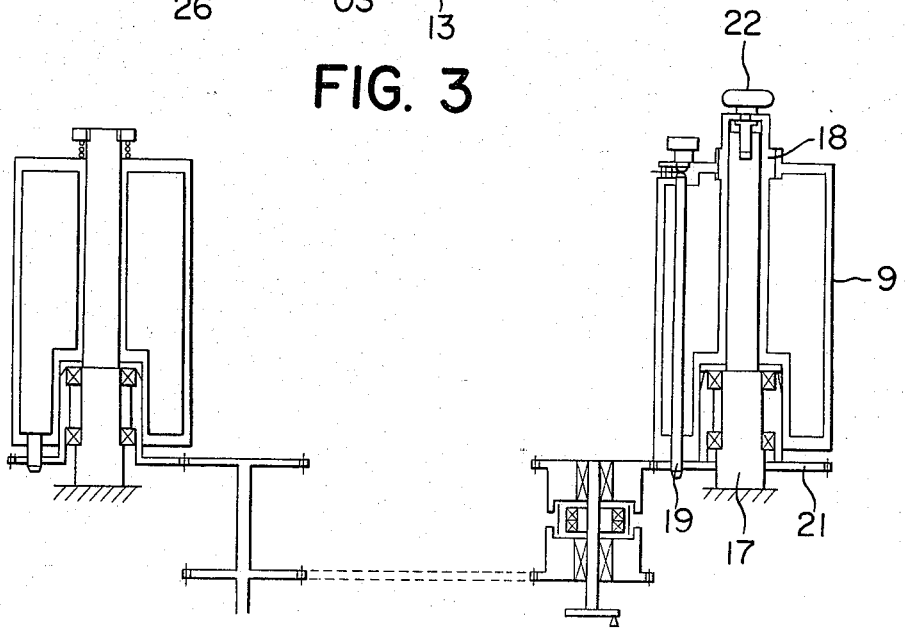
FIG. 3 shows the relation between a photosensitive drum and an image original drum.

The image original drum 9 is mounted on a fixed shaft 17 by means of bearings as shown in FIG. 3, and it is detachable from the shaft. The image original drum 9 has its position fixed by a reference positioning pin 19. The image original drum is driven through a gear 21. An adjust screw 22 is provided so as to enable the image original drum 9 to be moved axially on the fixed shaft 18 in order to adjust the position in the axial direction of the drum with respect to the other image formation stations IF-1 and IF-2 shown in FIG. 1.

Figure 2:
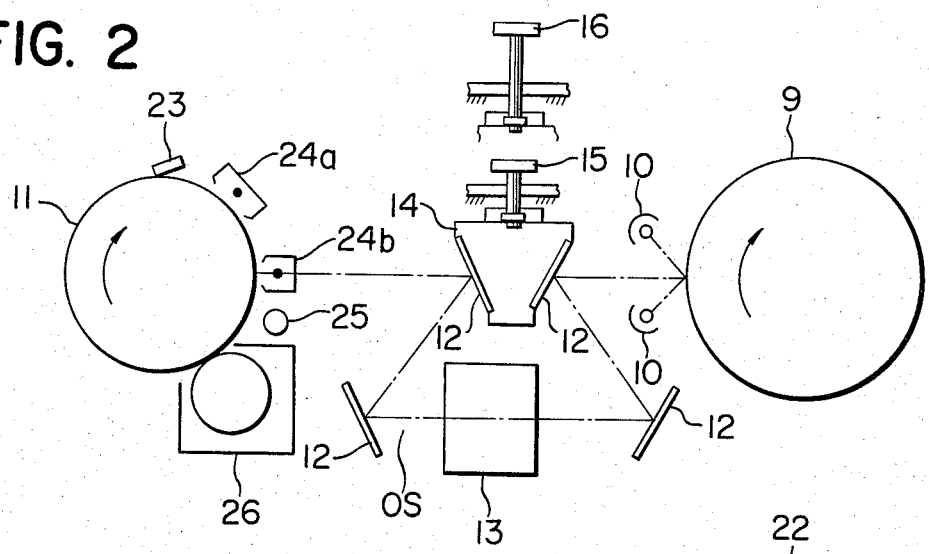
FIG. 2 shows details of the image formation apparatus of FIG. 1.

In FIG. 2, the photosensitive drum 1 has on the surface thereof three layers, namely, an insulating layer, a photoconductive layer thereunder, and a substrate (for example, aluminum) thereunder. When the photosensitive drum 11 is rotated by an unshown means, the surface thereof is cleaned by a cleaner blade 23 to remove the toner or the like thereon.

The photosensitive drum 11 so cleaned has the surface thereof uniformly charged to the positive polarity by the plus corona of a charger 24*a*. The image original at the portions thereof illuminated by the light source 10 is focused on the photosensitive drum 11 through the mirror 12 and the lens unit 14 and simultaneously therewith, the plus charge at the portions of the photosensitive drum exposed to the light is removed by the AC corona discharge of an AC charger 24*b*.

Next, the photosensitive drum 11 is irradiated with the light from a whole surface exposure lamp 25 to remove the charge from the substrate of the photosensitive drum 11.

The electrostatic latent image formed on the photosensitive drum in the manner as described above is developed into a visible image by the toner in a developing device 26.

Figure 5:
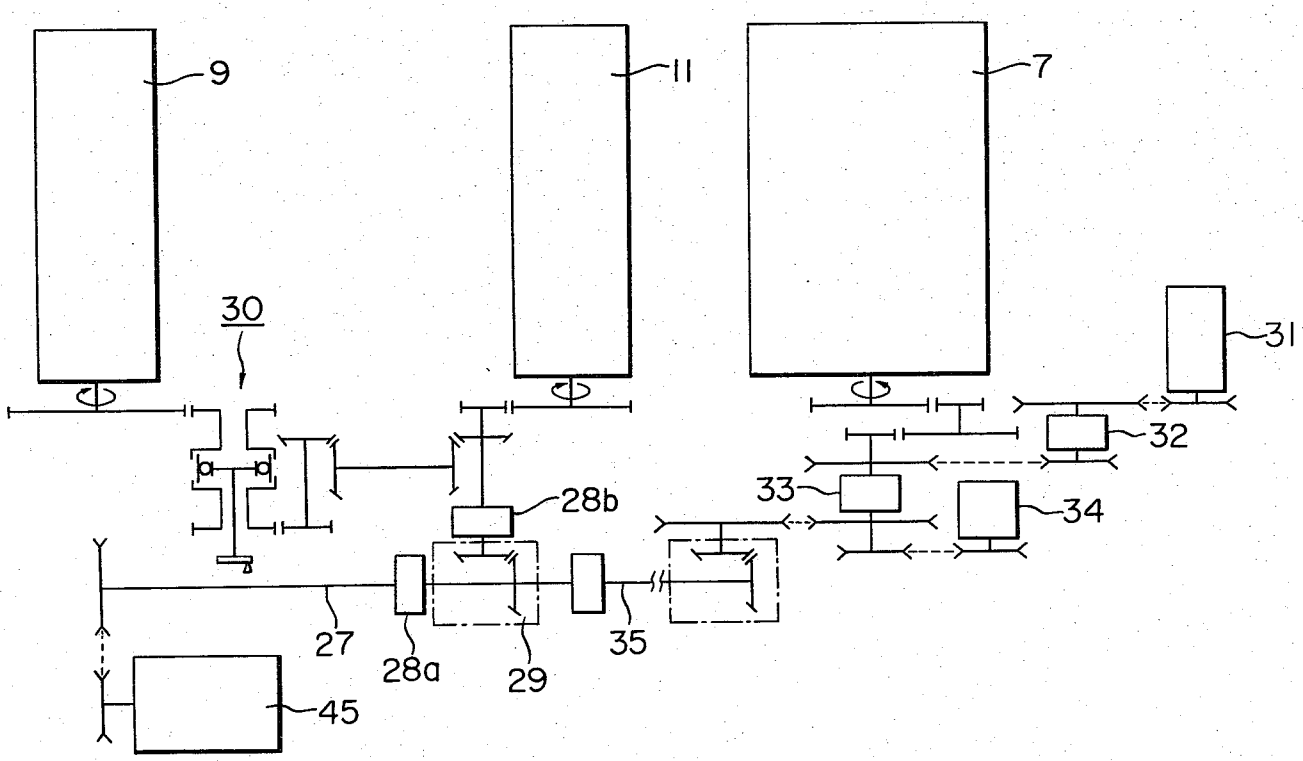
FIG. 5 shows the construction of the drive.

FIG. 5 shows a drive mechanism for the image original drum 9, the photosensitive drum 11 and the transfer belt driving drum 7. In FIG. 5, the plurality of image formation stations IF, IF-1 and IF-2 is such that the drive of a main motor 45 is transmitted to the drive shafts of the image original drum 9 and the photosensitive drum 11 through a spline shaft 27, a coupling 28*a* and a gear box 29.

Between the respective image formation stations IF, IF-1 and IF-2, the drive is transmitted through a spline shaft (not shown) between gear boxes 29. This construction is necessary in order to enable the photosensitive drum position at each station to be adjusted in a direction perpendicular to the transfer belt 6 and maintain the periodicity of the drive. Also, in effecting color printing by the use of a plurality of photosensitive drums, it is necessary to adjust the positional relationship between the respective photosensitive drums and therefore, a position adjusting unit 30 is provided between the image original drum and the synchronous drive system of the photosensitive drums. This unit may be, for example, a planetary gear which may comprise two sets of internal gears having slightly different numbers of gear teeth provided on a common shaft so that the directions of rotation may be made out of phase by the difference in number of gear teeth. This unit, once adjusted, can maintain the periodicity between the image original drum and the photosensitive drum by a lock mechanism.

On the other hand, the drive of the transfer belt is effected by the drive of an auxiliary electric motor 31 transmitted to the drive roller 7 through a clutch 32 (which is then in OFF position) and when the various conditions of the image formation stations IF, IF-1 and IF-2 have been satisfied, the clutch 32 and the auxiliary electric motor 31 are disconnected while a clutch 33 is connected to change over to the drive from the main motor.

In order to confirm the above-described synchronism, a tachogenerator 34 is provided and by the output of such tachogenerator, the change-over between the clutches 32 and 33 is effected automatically or manually. As regards the synchronism between the image formation stations and between the image formation stations and the transfer belt, not only the above-described mechanical synchronism but also electrical synchronism may occur to mind.

Figures 4, 4A:
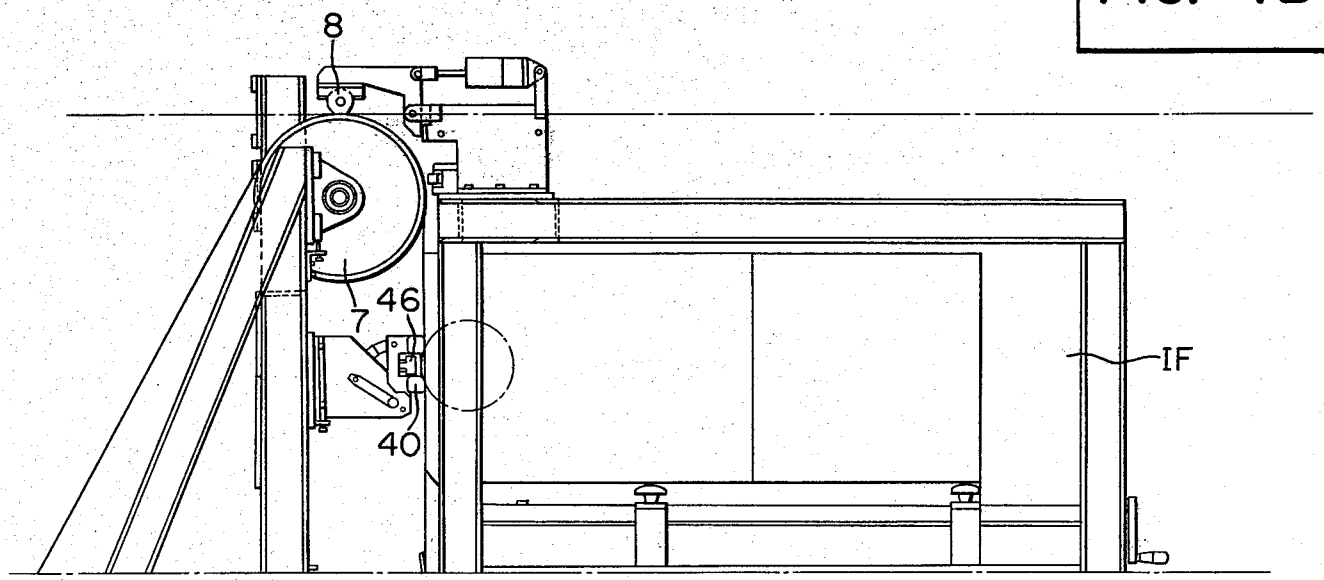
FIG. 4 illustrates the combination of FIGS. 4A and 4B.
FIG. 4A shows details of the image transfer station.
Figure 4B:
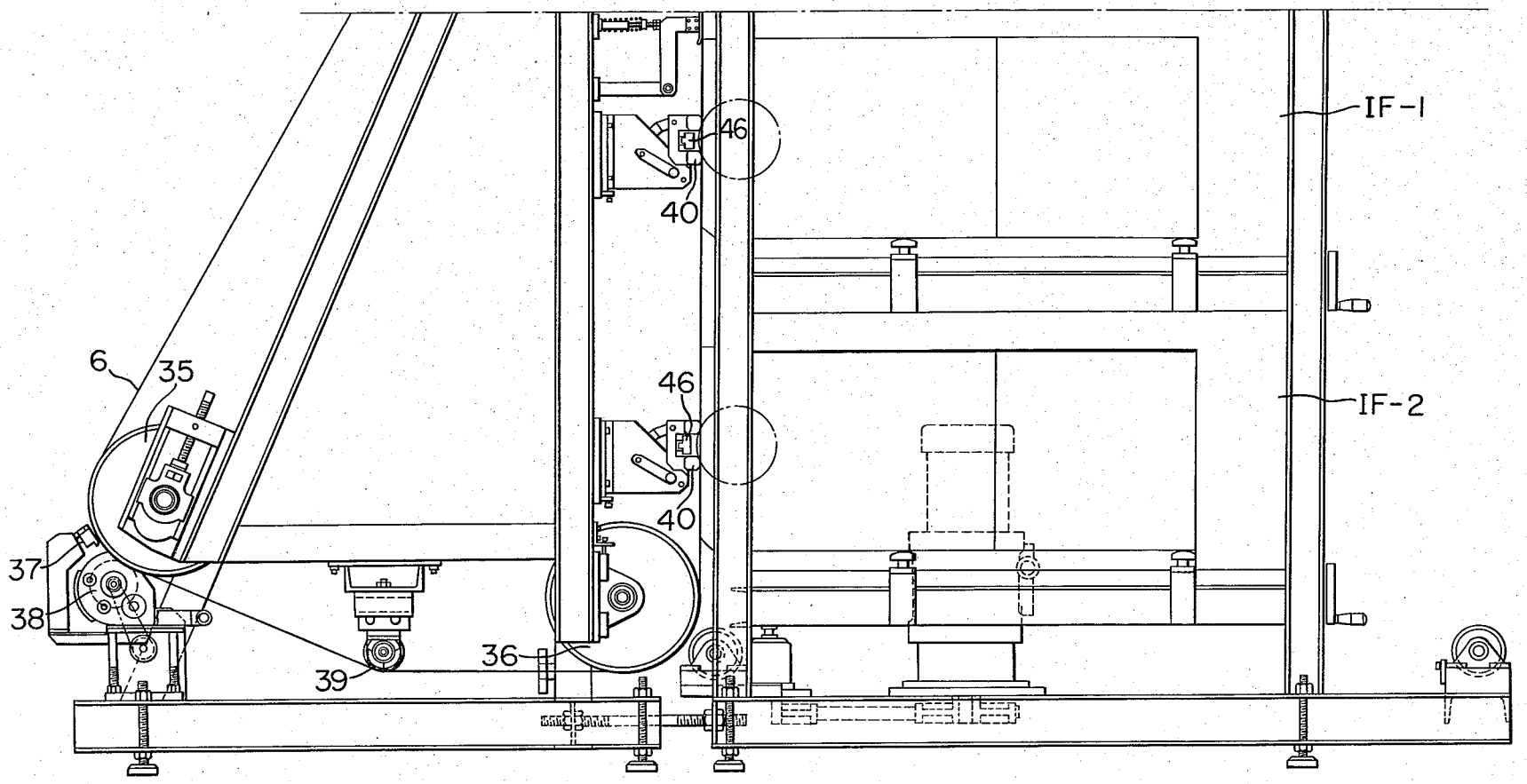
FIG. 4B shows the arrangement of the image formation station.

In FIG. 1, TI is an image transfer station and its details are shown in FIG. 4. In FIG. 4, the image transfer station TI comprises an image transfer belt 6, a drive drum 7, a press roll 8, guide rollers 35 and 36, a discharger 37, a cleaner 38, an edge controller 39 and a contact roller 40.

In the direct transfer method, the image transfer belt 6 directly transfers the images successively from a plurality of transfer stations to the web of cloth continuously and must be able to make intimate contact with the cloth. In the indirect transfer method, images are transferred from a plurality of image formation parts directly onto the image transfer belt 6 and the transferred images are ultimately transferred to the web of cloth by means of the press roll 8 and the image transfer belt must be able to transfer the images. As the material of the belt which can meet these requirements, a special rubber belt or a plastic belt (for example, polyester Teflon) may be used. Further, depending on the specific transfer charging method, conductivity or insulativeness is selected for such belts.

The edge controller 39 will further be described. This device is provided to prevent the widthwise deviation of the image transfer belt 6 and comprises a widthwise position detector, an adjust roller, an operating cylinder and a servo-mechanism for controlling these. The detector normally detects the widthwise position of the image transfer belt 6 and varies the angle of the roller through the servo-mechanism and the operating cylinder to thereby correct the widthwise positional deviation of the belt.

The belt drive drum 7 will now be described. It must have a sufficient friction coefficient with respect to the image transfer belt in order to continuously feed the image transfer belt without any slip. Therefore, the drive drum must be a metal drum or a precision metal drum lined with rubber.

The image transfer contact roller 40 is used to urge the image transfer belt 6 against the photosensitive drum. The contact roller comprises two rolls and is provided with a torque mechanism so as to be urged against the photosensitive drum. Also, an image transfer charger is provided intermediately of the two rolls. The urging mechanism may be of the cylinder type or of the cam type.

In case of the indirect transfer method, use is made of the press roll 8. The press roll is normally out of contact with the belt drive drum 7 and is urged against the latter when image transfer is effected. The mechanism for urging the press roll may be an air cylinder or a cam.

Designated by FU is a fixing unit. The web of cloth onto which images have been transferred passes through a heater part 41 and is fixed by the heat. Thereafter, in order to prevent color shift of the transferred images on the web of cloth, the web of cloth is cooled by a cooling roll 42 and a blower 43. The cooled web of cloth is directed to a shaking device 44 and stored in an unshown place. Instead of the shaking device, the web may be taken up by a take-up roll, not shown.

Figure 6:
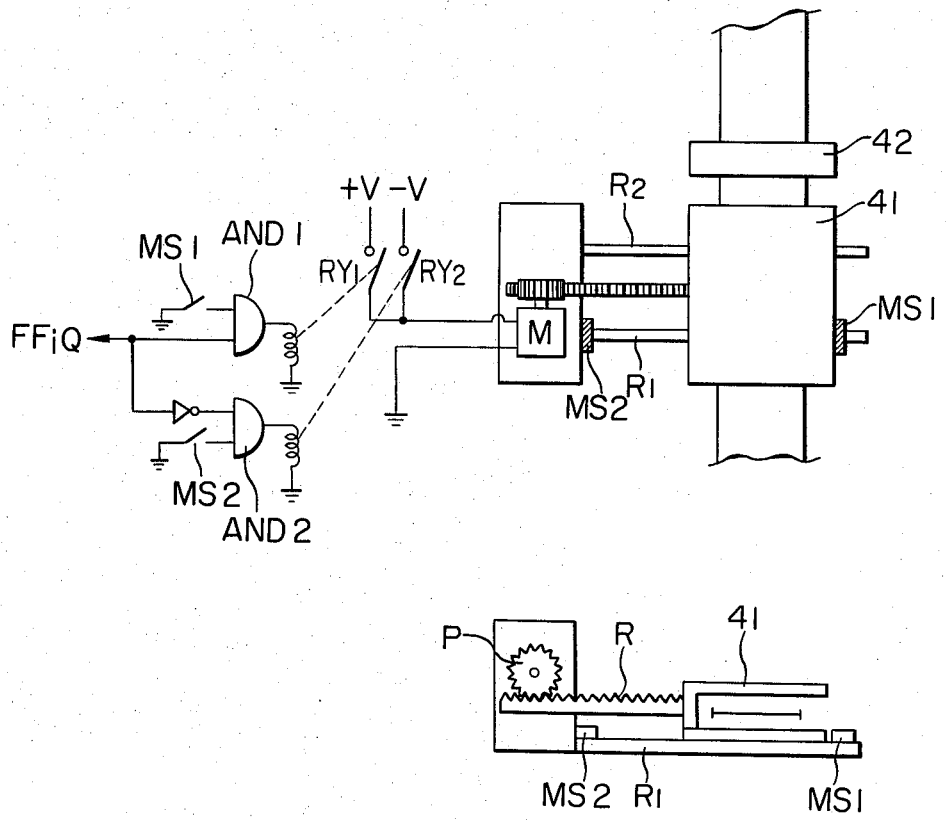
FIG. 6 shows details of the heater part.

The heater part 41 will further be described. The heater part 41 imparts heat to one or both sides of the cloth from an electric or other heat source and is provided with a mechanism for causing the heater part to slide in the direction perpendicular to the direction of movement of the cloth when the cloth is stationary. For example, as shown in FIG. 6, the heater part 41 is slidably mounted on rails R1 and R2 and a rack R fixed to the heater part is moved by a pinion P rotated by a motor (not shown) to move the heater part 41. Thus, the risk of the cloth being burnt by the heating of the heater part may be avoided.

Operation of the embodiment constructed and described above will be explained by reference to the control circuit diagram of FIG. 7 and the timing chart of FIG. 8.

Figure 7:
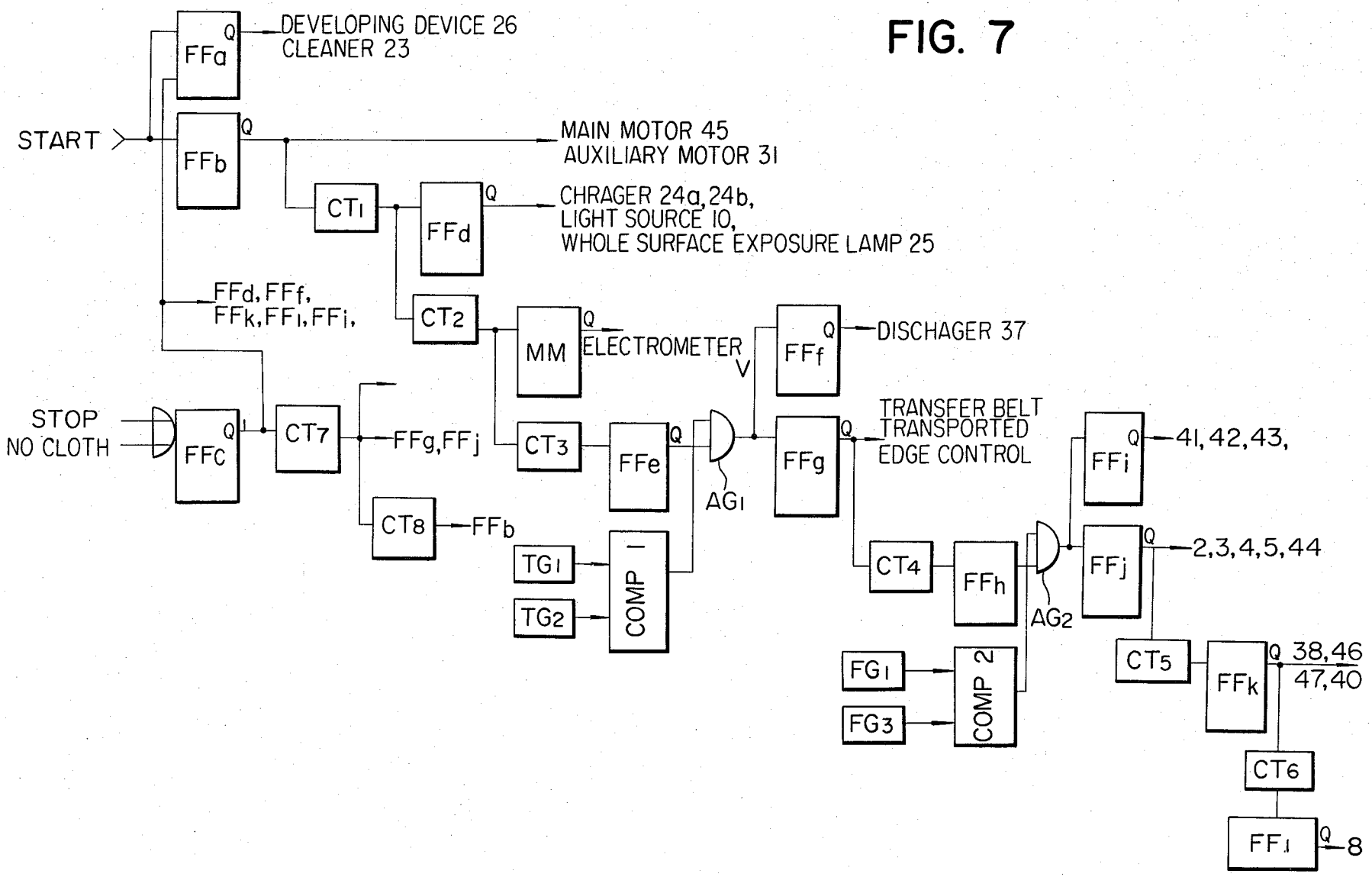
FIG. 7 is a diagram of the control circuit.
Figure 8B:
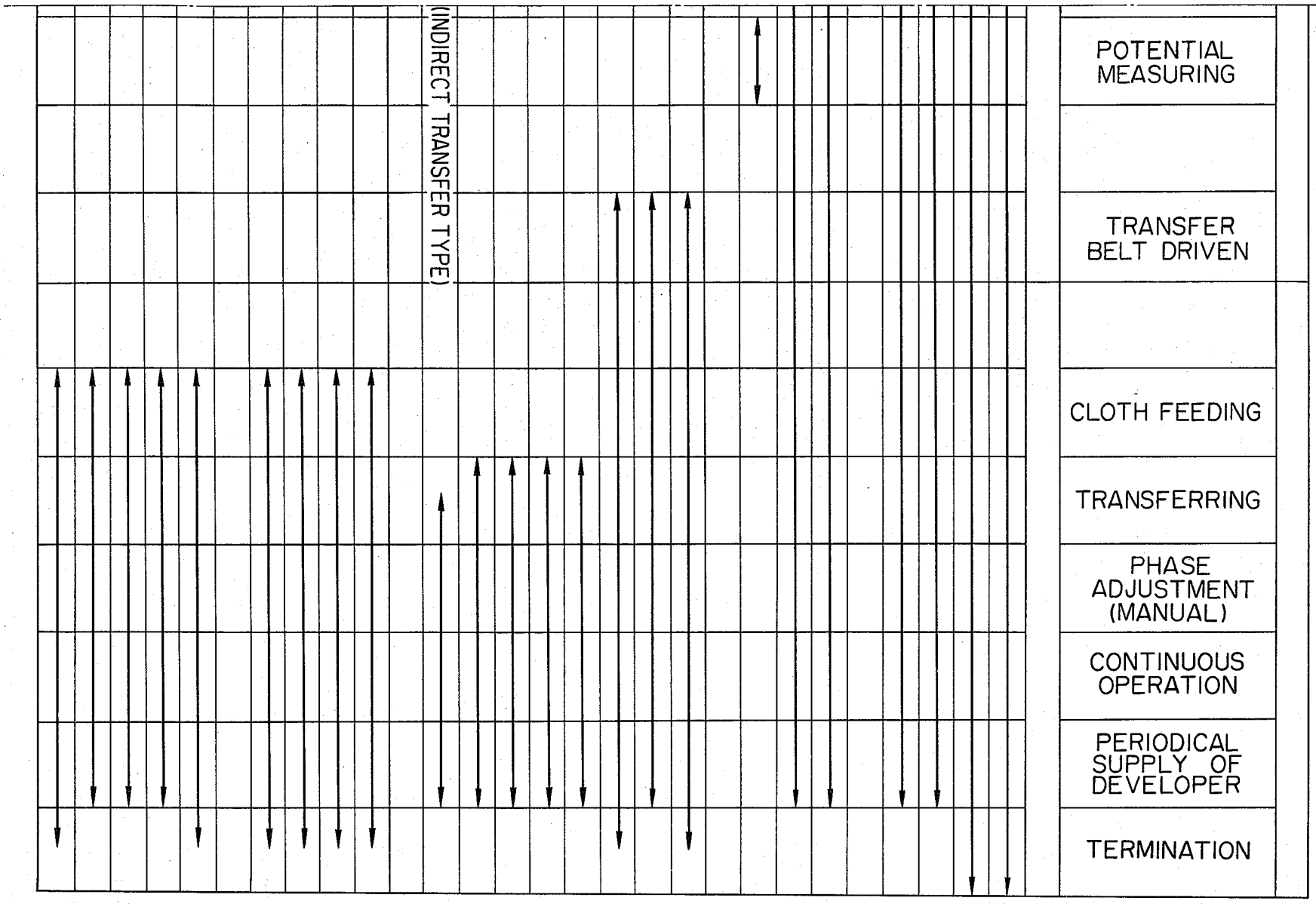

In FIG. 7, FF*a*–FF*l* are flip-flops which control ON-OFF of the necessary elements for transfer image formation. CT1–CT3 are timers for producing operation timing signals. Designated by AG1–AG2 are AND gates. OR is an OR gate to which is applied a deenergization stop signal or a signal from the cloth detector which means the absence of the cloth.

Figure 8:
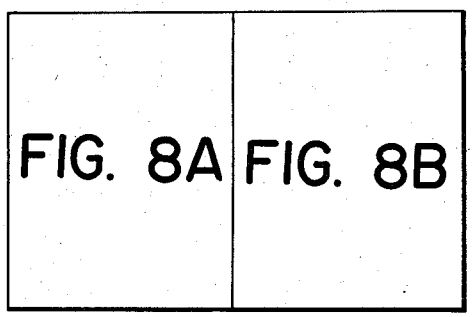
FIG. 8 is a timing chart.

FIG. 8 will now be referred to in order to describe the operation of the invention. When a start signal is applied to the flip-flops FF*a*–FF*b*, the Q outputs of the FF*a* and FF*b* are set to "1" and, to operate the image original drum 9 and the photosensitive drum 11 in response to such signal, an unshown solenoid is energized to effect power supply to the main electric motor 45. When the main motor 45 is supplied with power, it transmits its rotational force to a spline shaft 27 through a belt, a chain or the like. The rotational force transmitted to the spline shaft 27 is transmitted to the photosensitive drum 11 through a gear box 29 and its transmission system and to the image original drum 9 through a phase regulating unit 30, thus rotating the drums 11 and 9. The rotational force of the main motor 45 is used as the drive source for all the image formation station parts and is also transmitted to FF-1 and FF-2, as already noted.

The Q output of FF*b* also acts on the auxiliary motor 31 and connects the clutch 32 to rotate the image transfer belt drive roller 7. At this time, the other clutch 33 is disconnected and so, the rotational force of the main motor 45 is not being transmitted.

The developing device 26 and the cleaner 23 are also operated by the Q output of FF*b*.

Also, the timer CT1 is operated by the Q output of FF*b* and a predetermined time after, it sets the Q output of the flip-flop FF*d* to "1". The Q output of the flip-flop FF*d* operates the chargers 24*a* and 24*b*, the light source 10 and the whole surface exposure lamp 25 as well as the timer CT2. By the timer CT2, in a predetermined time thereafter, the Q output of a monomultivibrator MM is set to "1" for a predetermined time to operate a potentiometer V which measures the surface potential of the photosensitive drum 11. Further, the timer CT3 is driven. By the timer CT3, in a predetermined time thereafter, the Q output of the flip-flop FF*e* is set to "1" to open the AND gate AG1.

The output of a comparator compl which produces an output when synchronism is obtained between the image transfer belt 6 and the photosensitive drum 11 is applied to the other input terminal of the AND gate AG1. The comparison is done by the output data of the tachogenerator. When the comparator compl puts out a coincidence signal, the Q outputs of the flip-flops FF*f* and FF*g* are set and the drive of the image transfer belt 6 is changed over from the auxiliary motor 31 to the main motor 45, so that the clutch 33 is connected while the clutch 32 is disconnected. Further, the discharger 37 is operated to remove the charge on the image transfer belt 6. Of course, this refers to the chase of the indirect transfer method. The edge controller 39 is also operated in response to the Q output of the flip-flop FF*g* and the snake-like movement of the transfer belt 6 is corrected by the roller being inclined. The timer CT4 is operated by the flip-flop FF*g* and in a predetermined time, the Q output of the flip-flop FF*h* is set to "1" to open the AND gate AG2. Applied to the other input of the AND gate AG2 is an output representing whether the feed of the cloth is synchronized with the rotation of the photosensitive drum. Such output is obtained by the number of revolutions of the cloth feed torque motor and of the photosensitive drum being detected by the tachogenerator and by the detection signal being applied to a comparator compl 2. When the output is put out from the AND gate AG2, the Q outputs of the flip-flops FF*i* and FF*j* are set to "1" to operate the tracking device 2, cloth guider 3, dancer roll 4, torque motor 5, heater part 41, cooling roll 42, blower 43 and shaking device 44.

In the above-described stage, the image original on the image original drum 9 is formed as a visible toner image on the photosensitive drum 11 and the visible image is removed by the cleaner blade 23.

By a timer CT5, in a predetermined time, the Q output of the flip-flop FF*k* is set to "1". Such Q output of the flip-flop FF*k* operates the cleaner 38, the transfer charger 46, the discharger 47, the contact roller 40 and the press roll 8.

Therefore, the web of cloth fed to the image formation stations IF, IF-1 and IF-2 is nipped by and between the image transfer belt 6 and the photosensitive drum 11 so that the image on the photosensitive drum 11 is transferred onto the cloth. This operation takes place in each of the image formation stations. Also, once the image is transferred onto the web of the cloth in one image formation station, the charge on the web of cloth is removed by the discharger 47 and the next image is transferred in the next image formation station.

The present invention provides three image formation stations, but the number of the image formation stations may be increased or decreased as required. In the case of the indirect transfer, the web of cloth is fed in the direction of arrow A in FIG. 1, and the images transferred to the image transfer belt (here, three mosaic images) are further transferred by the press roll 8. When this process is terminated, the web of cloth is fixed at the heater part 41, whereafter the web of cloth overlaps, it is cooled down by the cooling roll 42 and the blower 43 so that the respective colors do not shift, and is then stored in a predetermined storage by the shaking device 44. In the case of the indirect transfer, the presss roll 8 drives the timer CT6 by the flip-flop FF*k* and in a predetermined time thereafter, the flip-flop FF*l* is set and driven.

In the above-described sequence of operation, the image original in each of the image formation stations IF, IF-1 and IF-2 is transferred.

By a termination stop signal or a signal representing the advance of the web of cloth, the Q output of the flip-flop FF*c* is set to "1" while the Q outputs of the flip-flops FF*a*, FF*d*, FF*f*, FF*k*, FF*i* are set to "0" and the shown operation to be controlled is stopped and the timer CT7 is set, by the output of which FF*g* and FF*j* are reset so as to stop the operation as shown and the timer CT8 is operated to reset the flip-flop FF*b*, and the shown operation to be controlled is stopped.

By the Q output of the flip-flop FF*i*, electrical energy is supplied to the heater part 41 and a relay RY1 is electrically energized through an AND gate AND1 to apply a plus voltage to a motor M and drive the same and move the heater part 41 until it is caused to strike against a microswitch MS1 by the rack R. When the microswitch MS1 detects the heater part 41, it is closed to close the AND gate AND1 to deenergize the relay RY1 and stop the motor M, so that the heater part comes to a halt at a predetermined position.

When the flip-flop FF*i* is reset, an AND gate AND2 is opened to energize a relay RY2 so that a minus voltage is applied to the motor M to reversely rotate the motor M, which moves the heater part 41 to a position off the path of the cloth. When a microswitch MS2 detects the heater part 41, it is closed to close the AND gate AND2 and deenergize the relay RY2. Thus, no minus voltage is now applied to the motor M, thereby stopping movement of the heater part 41.

The microswitches MS1 and MS2 are normally open and are closed when contacted by the heater part.

Figure 9:
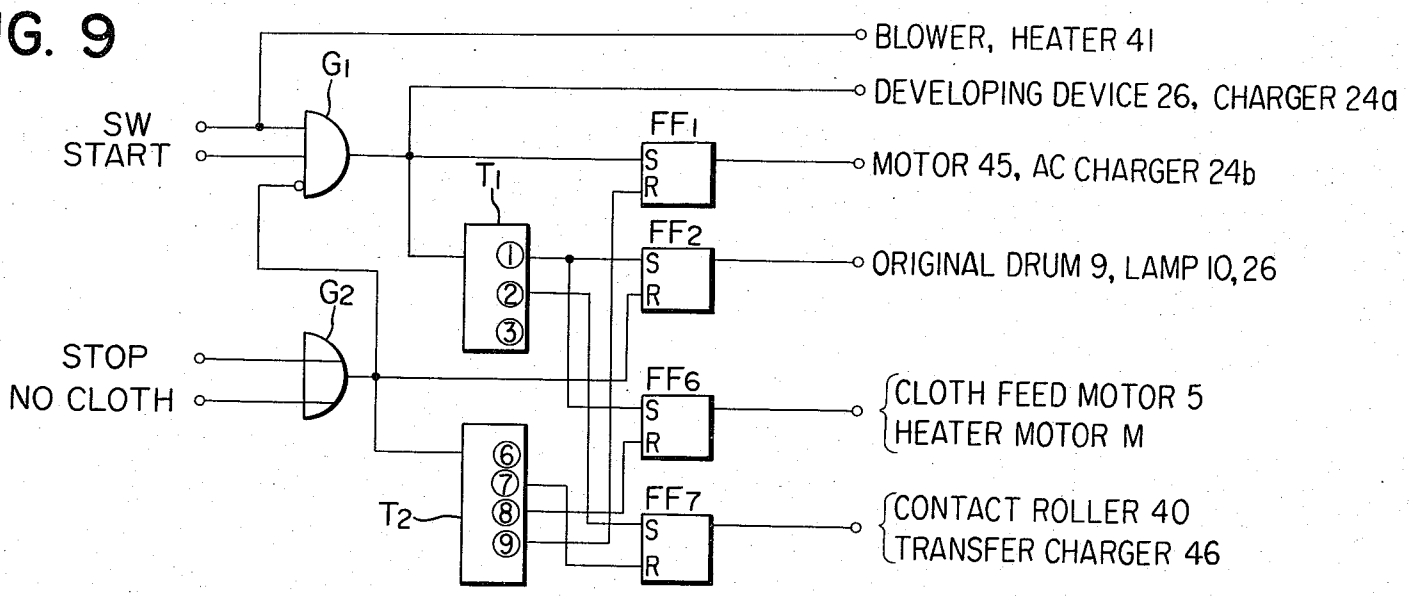
FIG. 9 is a diagram of the control circuit for another embodiment of the present invention.
Figure 10:
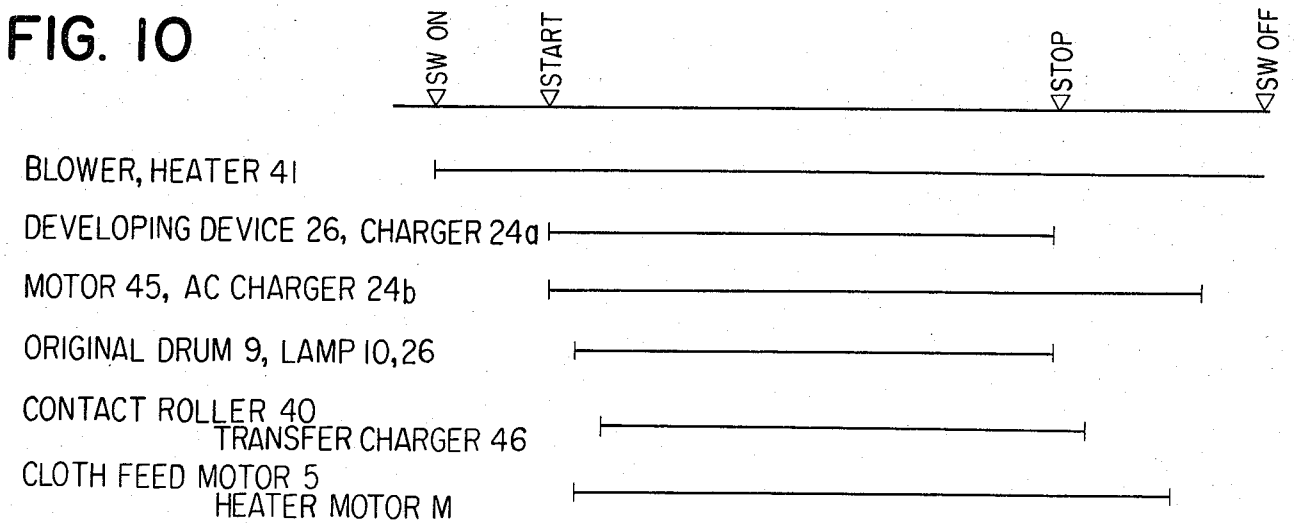
FIG. 10 is a timing chart.

FIG. 9 shows an example of the circuit of the direct transfer system, and FIG. 10 is an operation time chart thereof.

In FIG. 9, G1 is an AND gate for initiating the transfer image formation, G2 is an OR gate for stopping the transfer image formation, T1 and T2 are timers for forming operation timing signals, and FF1–FF3 are flip-flops for controlling ON-OFF of the necessary operating elements for the transfer image formation. Designated by SW is a signal representing level 1 when the power source switch is closed, STAT is a signal representing level 1 when the image formation staring button is closed, STOP is a signal representing level 1 when the image formation stop button is closed, and NO CLOTH is a signal representing level 1 when the cloth detector detects no cloth.

The circuit operation will be described by reference to FIG. 10. By the power source switch being closed, the blower 43 and the fixing heater 41 are electrically energized to make the apparatus ready to operate. At this point of time, as already mentioned, the heater is spaced apart from the cloth enough not to affect the latter. By the starting button being closed, the cloth is stretched from the cloth supply station to the cooling roll 42, so that the image formation process on the photosensitive drum 11 is started. First, by the gate G1 and FF1, the developing device 26, the AC charger **24*b* and the motor 45 are electrically energized and wait for their operations to become stable. The time limiting operation of the timer T1 is started at this time, and FF2 is energized by an output of level 1 and after a first timer time, the original drum starts rotating and the exposure lamp 10 is turned on, and thus formation of electrostatic latent image corresponding to the image on the original drum 9 is started on the photosensitive drum 11. Till that time, the photosensitive drum 11 has been pre-cleaned by a cleaning brush 23. At the same time, FF6 is set to electrically energize the cloth feed motor 5 and the heater motor M to initiate the feeding of the cloth. Thus, by pre-moving the cloth, the time when a stable velocity synchronous with the photosensitive drum 11 is obtained is waited for. The feed initiating time may be simultaneous with the signal STAT. The heater 41** is moved toward the cloth by the motor M to effect heating.

Subsequently, FF7 is set by the output of the timer T1, and the contact roller 40 is brought into contact with the surface of the photosensitive drum. A clutch (not shown) and a transfer charger 46 are electrically energized to initiate image transfer onto the cloth.

This point of time is that whereat the feeding of the cloth becomes stable, and it is preset by the timer from the rising characteristic of the drive system. By rotating the original drum 9 for a plurality of complete rotations, the same image is formed on the cloth and therefore, this point of time is not constrained by the initiation of the original exposure.

In the manner described above, patterns are repetitively obtained on a long footage of cloth. The operations such as the proper tensioning of the cloth, the anti-lateral deviation of the cloth, and the cleaning of the drum after fixation are similar to those in the indirect transfer method.

When the STOP signal or NO CLOTH signal is generated, the developing device 26, the charger **24*a*, the original drum 9 and the lamps 10, 25 are all stopped from operating by the gates G1, G2 and the flip-flop FF2. The photosensitive drum 11 continues to rotate and is post-cleaned by the cleaning brush 23. This takes place until the 9** output of the timer T2 which resets the FF1 is generated.

The contact roller clutch is disconnected by the 7 output of the timer T2. This takes place when the last toner image has been transferred. The cloth feeding motor 5 is deenergized by the 8 output of the timer T2. During this time, the last transferred image passes through the fixing area.

According to the present invention, as has hitherto been described, the electrostatic image formation and development are pre-effected on the photosensitive drum and after the movement of a long footage of transfer medium such as web of cloth has become synchronized with the rotation of the drum, the image transfer process is effected to thereby enable good reproduction of desired images to be obtained from the first.

What I claim is:

1. An image formation apparatus comprising:

means defining a plurality of drums each having an original image associated therewith;

a photosensitive medium;

means for forming a latent image corresponding to each original image on said photosensitive medium;

means for forming a visible image on the basis of the latent image;

means for transferring the visible image to a recording material; and means for adjusting the axial deviation of each of said drums to align the original images thereon such that the transferred visible images are aligned.

2. An apparatus according to claim 1, further comprising means for heat-fixing the image on said recording material.

3. An apparatus according to claim 2, further comprising means for removing said heat-fixing means out of the path of the recording material in response to a signal for stopping the image forming operation or a signal indicating the absence of recording material.

4. An apparatus according to claim 1, further comprising, control means for operating said latent image forming means and said visible image forming means during movement of said photosensitive medium, and for allowing said transfer means to start its transferring operation after the movement of the recording material becomes synchronized with the movement of said photosensitive medium;

wherein the recording material is first fed by a first driving means and is then fed by a second driving means which also drives said photosensitive medium.

5. An apparatus according to claim 4, wherein said control means includes a control logic circuit having a timer function.

6. An image formation apparatus comprising:

a rotatable photosensitive medium;

means for forming a latent image on said photosensitive medium;

means for developing the latent image with toner into a toner image;

means for transferring the toner image onto a transfer web, said transfer means including an intermediate transfer material to which the toner image may be transferred prior to transfer onto the transfer web;

means for feeding the transfer web; and control means for operating said image forming means and said developing means, while rotating said rotatable photosensitive medium, and for allowing said transfer means to start its transferring operation after the movement of the transfer web by said feeding means becomes synchronized with the peripheral movement of said rotatable photosensitive medium;

wherein said intermediate transfer material is first fed by a first driving source and then fed by a second driving source which also drives said rotatable photosensitive medium.

7. An apparatus according to claim 6, wherein said control means includes a logic discriminating means.

8. An apparatus according to claim 7, further comprising a drum having an original image for the latent image formed on said rotatable photosensitive medium.

9. An apparatus according to claim 8, further comprising means for controlling the length of the optical path between said rotatable photosensitive medium and said drum.

10. An apparatus according to claim 6, wherein said feeding means includes a dancer roll whose weight applies tension to the transfer web.

11. An image formation apparatus comprising:

a photosensitive medium;

means for forming a latent image on said photosensitive medium;

means for forming a visible image on the basis of the latent image; and means for transferring the visible image onto a recording material;

wherein said transfer means includes an intermediate transfer material onto which the visible image may first be transferred onto an intermediate transfer material and then transferred onto the recording material, and wherein said transfer means defines first and second transfer paths along which the recording material is alternatively conveyed, the visible image being transferred from the intermediate transfer material onto the recording material when conveyed along the first path and the visible image being directly transferred onto the recording medium when conveyed along the second path.

12. An image formation apparatus comprising:

a group of drums each having an original image associated therewith;

a group of rotatable photosensitive mediums each facing an associated drum;

means for forming corresponding latent images of the original images on each of said drums;

means for developing the latent images with toner into toner images;

means for transferring the toner images onto a recording web;

means for driving the drums synchronously;

means for driving the photosensitive mediums synchronously with said drums;

a belt positioned to face each of said photosensitive mediums;

pressure means disposed in opposition to said belt; and feeding means defining first and second feeding paths along which said recording web is alternatively conveyed, wherein said toner images are first transferred to said belt and then transferred onto the recording web by said pressure means when conveyed along the first path, and wherein said recording web is fed by said belt while the toner images on said photosensitive mediums are directly transferred onto the recording web when conveyed along the second path.

13. An apparatus according to claim 12, further comprising control means for operating said image forming means and developing means, while rotating said photosensitive medium, and for allowing said transfer means to operate after the movement of the recording web by said belt becomes synchronized with the peripheral movement of said rotatable photosensitive medium.

* * * * *